US005479522A

United States Patent [19]

Lindemann et al.

[11] Patent Number: 5,479,522

[45] Date of Patent: Dec. 26, 1995

[54] BINAURAL HEARING AID

[75] Inventors: Eric Lindemann; John L. Melanson, both of Boulder, Colo.

[73] Assignee: AudioLogic, Inc., Boulder, Colo.

[21] Appl. No.: 123,499

[22] Filed: Sep. 17, 1993

[51] Int. Cl.[6] ..... H04R 25/00

[52] U.S. Cl. ..... 381/68.2; 381/68; 381/68.4

[58] Field of Search ..... 381/68, 68.2, 68.4, 381/97, 98, 94, 104, 106, 107, 60, 68.1

[56] References Cited

U.S. PATENT DOCUMENTS

| | | | |
|---|---|---|---|
| 3,509,289 | 4/1970 | Briskey et al. . | |
| 3,894,196 | 7/1975 | Briskey . | |
| 4,531,229 | 7/1985 | Coulter | 381/68 |
| 4,773,095 | 9/1988 | Zwicker et al. . | |
| 4,904,078 | 2/1990 | Gorike . | |
| 4,947,432 | 8/1990 | Tøpholm | 381/68.2 |
| 5,027,410 | 6/1991 | Williamson et al. | 381/68.4 |
| 5,289,544 | 2/1994 | Franklin | 381/68 |

*Primary Examiner*—Curtis Kuntz
*Assistant Examiner*—Huyen D. Le
*Attorney, Agent, or Firm*—Homer L. Knearl

[57] ABSTRACT

This invention relates to a hearing enhancement system having an ear device for each of the wearer's ears, each ear device has a sound transducer, or microphone, and a sound reproducer, or speaker, and associated electronics for the microphone and speaker. Further, the electronic enhancement of the audio signals is performed at a remote digital signal processor (DSP) likely located in a body pack worn somewhere on the body by the user. There is a down-link from each ear device to the (DSP) and an up-link from the DSP to each ear device. The DSP digitally interactively processes the audio signals for each ear based on both of the audio signals received from each ear device. In other words, the enhancement of the audio signal for the left ear is based on the both the right and left audio signals received by the DSP.

In addition digital filters implemented at the DSP have a linear phase response so that time relationships at different frequencies are preserved. The digital filters have a magnitude and phase response to compensate for phase distortions due to analog filters in the signal path and due to the resonances and nulls of the ear canal.

15 Claims, 11 Drawing Sheets

NOTE: THIS CIRCUIT IS REPEATED FOR EVERY FREQUENCY F OF THE FFT

157

BINAURAL HEARING AID

CROSS REFERENCE TO RELATED APPLICATIONS

The present invention relates to patent application entitled "Noise Reduction System For Binaural Hearing Aid" Ser. No. 08/123,503, filed Sep. 17, 1993, which claims the noise reduction system disclosed in the present system architecture invention.

BACKGROUND OF THE INVENTION

Field of the Invention

This invention relates to binaural hearing aids, and more particularly, a system architecture for binaural hearing aids. This architecture enhances binaural hearing for a hearing aid user by digital signal processing the stereo audio signals.

Description of Prior Art

Traditional hearing aids are analog devices which filter and amplify sound. The frequency response of the filter is designed to compensate for the frequency dependent hearing loss of the user as determined by his or her audiogram. More sophisticated analog hearing aids can compress the dynamic range of the sound bringing softer sounds above the threshold of hearing, while maintaining loud sounds at their usual levels so that they do not exceed the threshold of discomfort. This compression of dynamic range may be done separately in different frequency bands.

The fitting of an analog hearing aid involves the audiologist, or hearing aid dispenser, selecting the frequency response of the aid as a function of the user's audiogram. Some newer programmable hearing aids allow the audiologist to provide a number of frequency responses for different listening situations. The user selects the desired frequency response by means of a remote control or button on the hearing aid itself.

The problems most often identified with traditional hearing aids are: poor performance in noisy situations, whistling or feedback, lack of directionality in the sound. The poor performance in noisy situations is due to the fact that analog hearing aids amplify noise and speech equally. This can be particularly bothersome when dynamic range compression is used causing normally soft background noises to become annoyingly loud and bothersome.

Feedback and whistling occur when the gain of the hearing aid is turned up too high. This can also occur when an object such as a telephone receiver is brought in proximity to the ear. Feedback and whistling are particularly problematic for people with moderate to severe hearing impairments, since they require high gain in their hearing aids.

Lack of directionality in the sound makes it difficult for the hearing aid user to select or focus on sounds from a particular source. The ability to identify the direction from which a sound is coming depends on small differences in the time of arrival of a sound at each ear as well as differences in loudness level between the ears. If a person wears a hearing aid in only one ear, then the interaural loudness level balance is upset. In addition, sound phase distortions caused by the hearing aid will upset the perception of different times of arrival between the ears. Even if a person wears an analog hearing aid in both ears, these interaural perceptions become distorted because of non-linear phase response of the analog filters and the general inability to accurately calibrate the two independent analog hearing aids.

Another source of distortions is the human ear canal itself. The ear canal has a frequency response characterized by sharp resonances and nulls with the result that the signal generated by the hearing device which is intended to be presented to the ear drum is, in fact, distorted by these resonances and nulls as it passes through the ear canal. These resonances and nulls change as a function of the degree to which the hearing aid closes the ear canal to air outside the canal and how far the hearing aid is inserted in the ear canal.

SUMMARY OF THE INVENTION

In accordance with this invention, the above problems are solved by a hearing enhancement system having an ear device for each of the wearer's ears, each ear device has a sound transducer, or microphone, and a sound reproducer, or speaker, and associated electronics for the microphone and speaker. Further, the electronic enhancement of the audio signals is performed at a remote Digital Signal Processor (DSP) likely located in a body pack worn somewhere on the body by the user. There is a down-link from each ear device to the (DSP) and an up-link from the DSP to each ear device. The DSP digitally interactively processes the audio signals for each ear based on both of the audio signals received from each ear device. In other words, the enhancement of the audio signal for the left ear is based on both the right and left audio signals received by the DSP.

In addition, digital filters implemented at the DSP have a linear phase response so that time relationships at different frequencies are preserved. The digital filters have a magnitude and phase response to compensate for phase distortions due to analog filters in the signal path and due to the resonances and nulls of the ear canal.

Each of the left and right audio signals is also enhanced by binaural noise reduction and by binaural compression and equalization. The noise reduction is based on a number of cues, such as sound direction, pitch, voice detection. These cues may be used individually, but are preferably used cooperatively resulting in a noise reduction synergy. The binaural compression compresses the audio signal in each of the left and right channels to the same extent based on input from both left and right channels. This will preserve important directionality cues for the user. Equalization boosts, or attenuates, the left and right signals as required by the user.

The great advantage of the invention is that its system architecture, which uses digital signal processing with right and left audio inputs together, opens the way to solutions of all the prior art problems. A digital signal processor, which receives audio signals from both ears simultaneously, processes these sounds in a synchronized fashion and delivers time and loudness aligned signals to both ears. This makes it possible to enhance desired sounds and reduce undesired sounds without destroying the ability of the user to identify the direction from which sounds are coming.

Other features and advantages of the invention will be apparent to those skilled in the art upon reference to the following Detailed Description which refers to the following drawings.

DESCRIPTION OF THE PREFERRED EMBODIMENTS

Figure 1A:
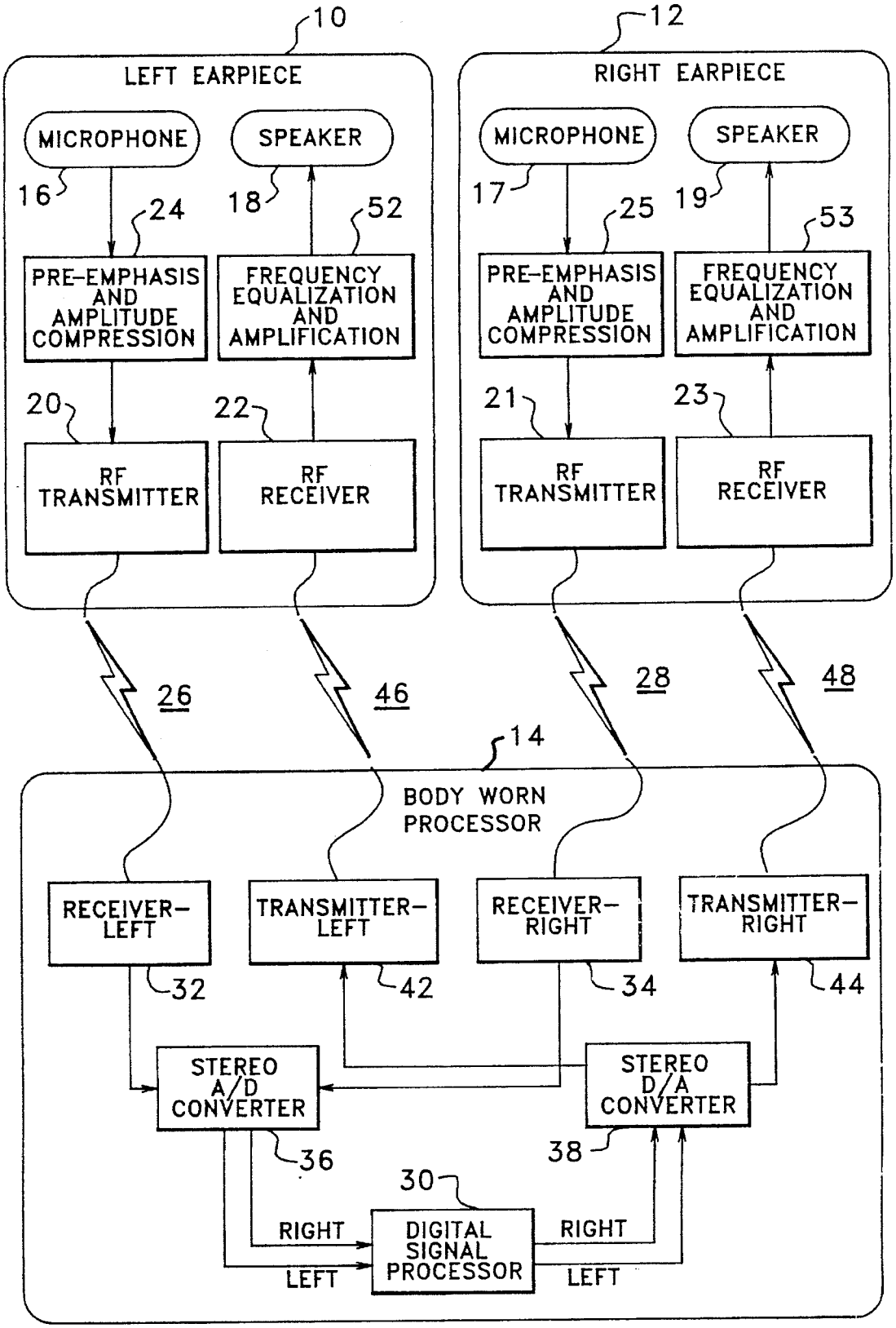
FIG. 1A is an overview of the preferred embodiment of the invention and includes a right and left ear piece, a remote Digital Signal Processor (DSP) and four transmission links between ear pieces and processor.

In the preferred embodiment of the invention, there are three devices—a left-ear piece 10, a right ear-piece 12 and a body-pack 14 containing a Digital Signal Processor (DSP). Each ear piece is worn behind or in the ear. Each of the two ear pieces has a microphone 16, 17 to detect sound level at the ear and a speaker 18, 19 to deliver sound to the ear. Each ear piece also has a radio frequency transmitter 20, 21 and receiver 22, 23.

The microphone signal generated at each ear piece is passed through an analog preemphasis filter and amplitude compressor 24, 25 in the ear piece. The preemphasis and compression of the audio analog signal reduces the dynamic range required for radio frequency transmission. The preemphasized and compressed signals from ear pieces 10 and 12 are then transmitted on two different radio frequency broadcast channels 26 and 28, respectively, to body pack 14 with the DSP.

The body pack may be a small box which can be worn on the belt or carried in a pocket or purse, or if reduced in size, may be worn on the wrist like a wristwatch. Body pack 14 contains a stereo radio frequency transceiver (left receiver 32, left transmitter 42, right receiver 34 and right transmitter 44), a stereo analog-to-digital A/D converter 36, a stereo digital-to-analog (D/A) converter 38 and a programmable digital signal processor 30. DSP 30 includes a memory and input/output peripheral devices for working storage and for storing and loading programs or control information.

Body pack 14 has a left receiver 32 and a right receiver 34 for receiving the transmitted signals from the left transmitter 20 and the right transmitter 21, respectively. The A/D converter 36 encodes these signals to right and left digital signals for DSP 30. The DSP passes the received signals through a number of processing stages where the left and right audio signals interact with each other as described hereinafter. Then DSP 30 generates two processed left and right digital audio signals. These right and left digital audio signals are converted back to analog signals by D/A converter 38. The left and right processed audio analog signals are then transmitted by transmitters 42, 44 on two additional radio frequency broadcast channels 46, 48 to receivers 22, 24 in the left and right ear pieces 10, 12 where they are demodulated. In each ear piece, frequency equalizer and amplifier 52, 53 deemphasize and expand the left and right analog audio signals to restore the dynamic range of the signals presented to each ear.

Figure 1B:
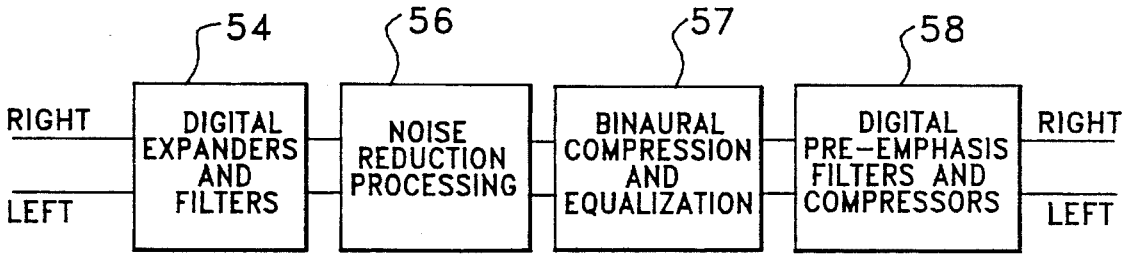
FIG. 1B is an overview of the processing performed by the digital signal processor in FIG. 1A.

In FIG. 1B, the three digital audio processing stages of DSP 30 are shown. The first processing stage 54 consists of a digital expander and digital filter, one for each of the two signals coming from the left and right ear pieces. The expanders cancel the effects of the analog compressors 24, 25 in the ear pieces and so restore the dynamic range of the received left and right digital audio data. The digital filters are used to compensate for (1) amplitude and phase distortions associated with the non-ideal frequency response of the microphones in the ear pieces and (2) amplitude and phase distortions associated with the analog preemphasis filters in the ear pieces. The digital filter processing at stage 54 has a non-linear phase transfer characteristic. The overall effect is to generate flat, linear-phase frequency responses for the audio signals from ear canals to the DSP. The digital filters are designed to deliver phase aligned signals to DSP 30, which accurately reflect interaural delay differences at the ears.

The second processing stage 56 is a noise-reducing stage. Noise reduction, as applied to hearing aids, means the attenuation of undesired signals (noise) and the amplification of desired signals. Desired signals are usually speech that the hearing aid user is trying to understand. Undesired signals can be any sounds in the environment which interfere with the principal speaker. These undesired sounds can be other speakers, restaurant clatter, music, traffic noise, etc. Noise reduction stage 56 uses a combination of directionality information, long term averages, and pitch cues to separate the sound into noise and desired signal. The noise-reducing stage relies on the right and left signals being delivered from the ears to the DSP with little, or no, phase and amplitude distortion. Once noise and desired signal have been separated, they may be processed to enhance the right and left signals with no noise or in some cases with some noise reintroduced in the right and left audio signals presented to the user. The noise reduction stage is shown in more detail in FIG. 4 and described hereinafter.

After noise reduction, the next processing stage 57 is binaural compression and equalization. Compression of the audio signal to enhance hearing is useful for rehabilitation of recruitment, a condition in which the threshold of hearing is higher than normal, but the level of discomfort is the same or less than normal. In other words, the dynamic range of the recruited ear is less than the dynamic range of the normal ear. Recruitment may be worse at certain frequencies than at others.

A compressor can amplify soft sounds while keeping loud sounds at normal listening level. The dynamic range is reduced making more sound audible to the recruited ear. A compressor is characterized by a compression ratio: input dynamic range in Db/output dynamic range in Db. A ratio of 2/1 is typical. Compressors are also characterized by attack and release time constants. If the input to the compressor is at a low level so that the compressor is amplifying the sound, the attack time is the time it takes the compressor to stop amplifying after a loud sound is presented. If the input to the compressor is at a high level so that the compressor is not amplifying, the release time is the time it takes the compressor to begin amplifying after the level drops. Compressors with fast attack and decay times (e.g., 5 ms, 30 ms respectively) try to adjust loudness level on a syllable by syllable basis. Slow compressors with time constants of approximately 1 second are often called automatic gain control circuits (AGC). Multiband compressors divide the input signal into 2 or more frequency bands and apply a separate compressor with its own compression ratio and attack/release time constants to each band.

In the current technology, a binaural hearing aid means a separate hearing aid in each ear. If these hearing aids use compression, then the compressors in each ear function independently. Therefore, if a sound coming from off angle arrives at both ears but is somewhat softer in one ear than the other, then the compressors will tend to equalize the level at the two ears. This equalization tends to destroy important directionality queues. The brain compares loudness levels and time of arrival of sounds at the two ears to determine directionality. In order to preserve directionality, it is important to preserve these queues. The binary compression stage does this.

The fourth processing stage 58 is the complement of the first processing stage 56. It implements digital compressors and digital preemphasis filters, one for each of two signals going to the left and right ear pieces, for improved dynamic range in RF transmission to the ear pieces. The effects of these compressors and preemphasis filters is canceled by analog expanders and analog deemphasis filters 52, 53 in the left and right ear pieces. The digital preemphasis filter operation in DSP 30 is designed to cancel effects of ear resonances and nulls, speaker amplitude and phase distortions in the ear pieces, and amplitude and phase distortions due to the analog deemphasis filters in the ear pieces. The digital filters implemented by DSP 30 have non-linear phase transfer characteristic, and the overall effect is to generate flat, linear-phase frequency responses from DSP to ear canals. Thus, phase aligned audio signals are delivered to the ears so that the user can detect sound directionality, and thus the location of the sound source. The frequency response of these digital filters is determined from ear canal probe microphone measurements made during fitting. The result will in general be a different frequency response characteristic for each ear.

There are many possible implementations of full duplex, radio transceivers that could be used for the four RF links or channels 26, 28, 46 and 48. Two preferred embodiments are shown in FIGS. 2A, 2B, 2C and 2D and FIGS. 3A, 3B, 3C and 3D, respectively. In the first preferred embodiment in FIGS. 2A–2D, analog FM modulation is used for all of the links. Full duplex operation is allowed by choosing four different frequencies for the four links. The two output channels 46, 48 will be at approximately 250 Khz and 350 Khz, while the two input channels 26, 28 will be at two frequencies near 76 Mhz. It will be appreciated by one versed in the art, that many other frequency choices are possible. Other forms of modulation are also possible.

Figure 2A:
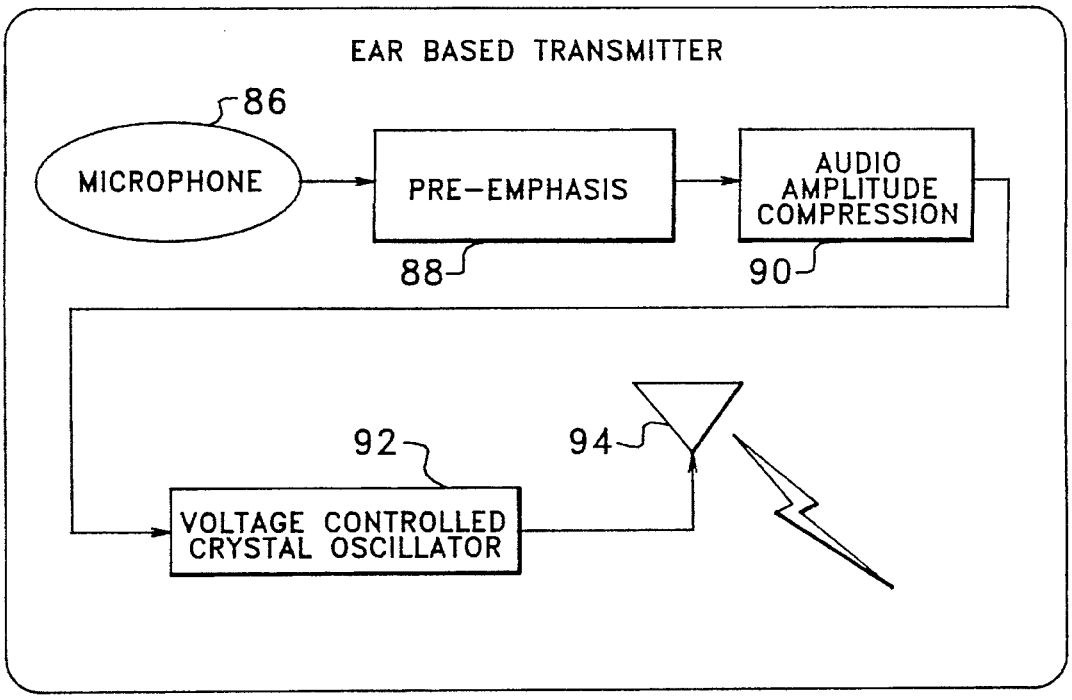
FIG. 2A illustrates an ear piece transmitter for one preferred embodiment of the invention using a frequency modulation (FM) transmission input link to the remote DSP.
Figure 2B:
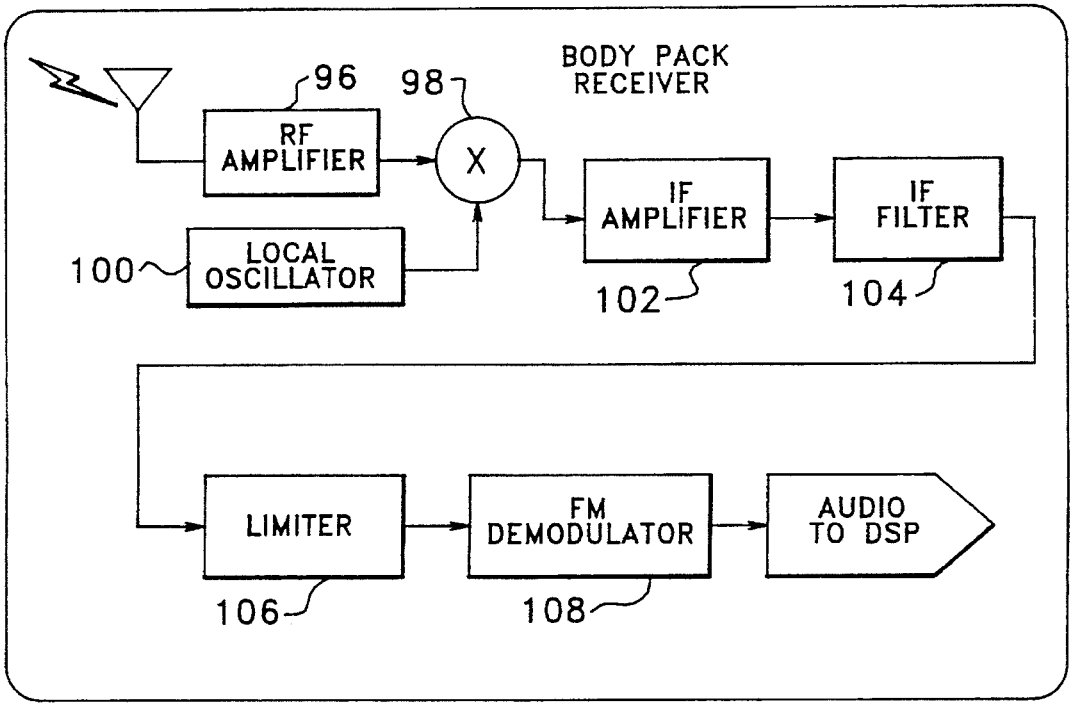
FIG. 2B illustrates an FM receiver at the remote DSP for use with the ear piece transmitter in FIG. 2A to complete the input link from ear piece to DSP.
Figure 2C:
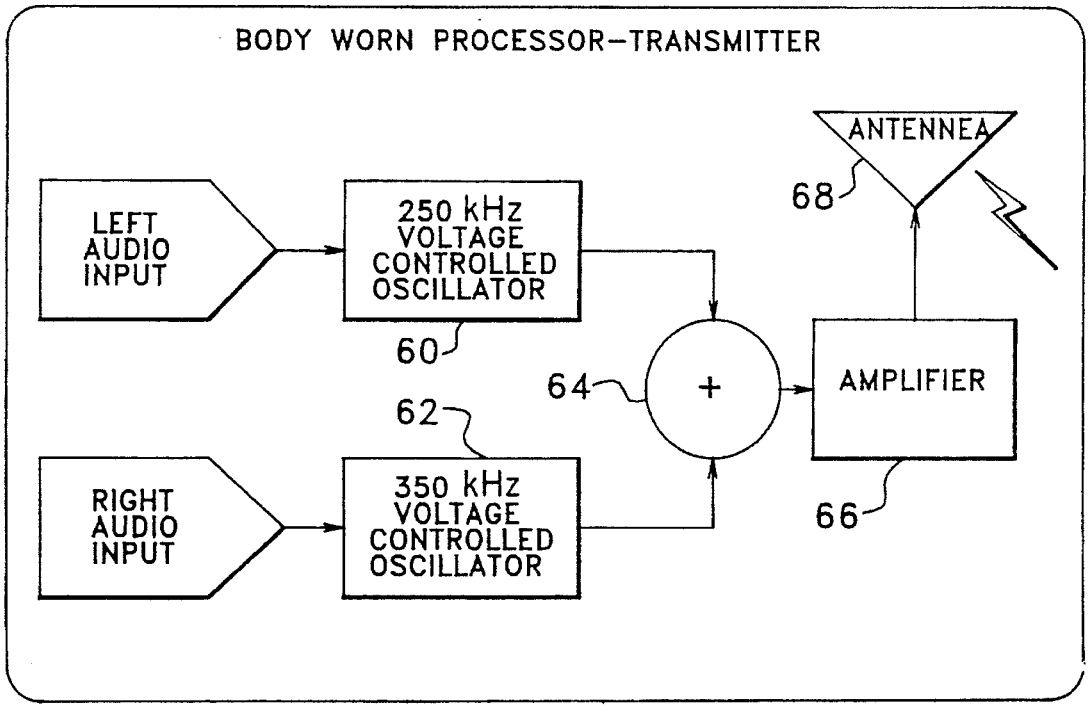
FIG. 2C illustrates an FM transmitter at the remote DSP for the FM transmission output link from the DSP to an ear piece.

The transmitter in FIG. 2C for the two output links has two variable frequency, voltage controlled oscillators 60 and 62 driving a summer 64 and an amplifier 66. The left and right analog audio signals from D/A converter 38 (FIG. 1A) control the oscillators 60 and 62 to modulate the frequency on the left and right links. Modulation is + or − 25 Khz. The amplified FM signal is passed to a ferrite rod antenna 68 for transmission.

Figure 2D:
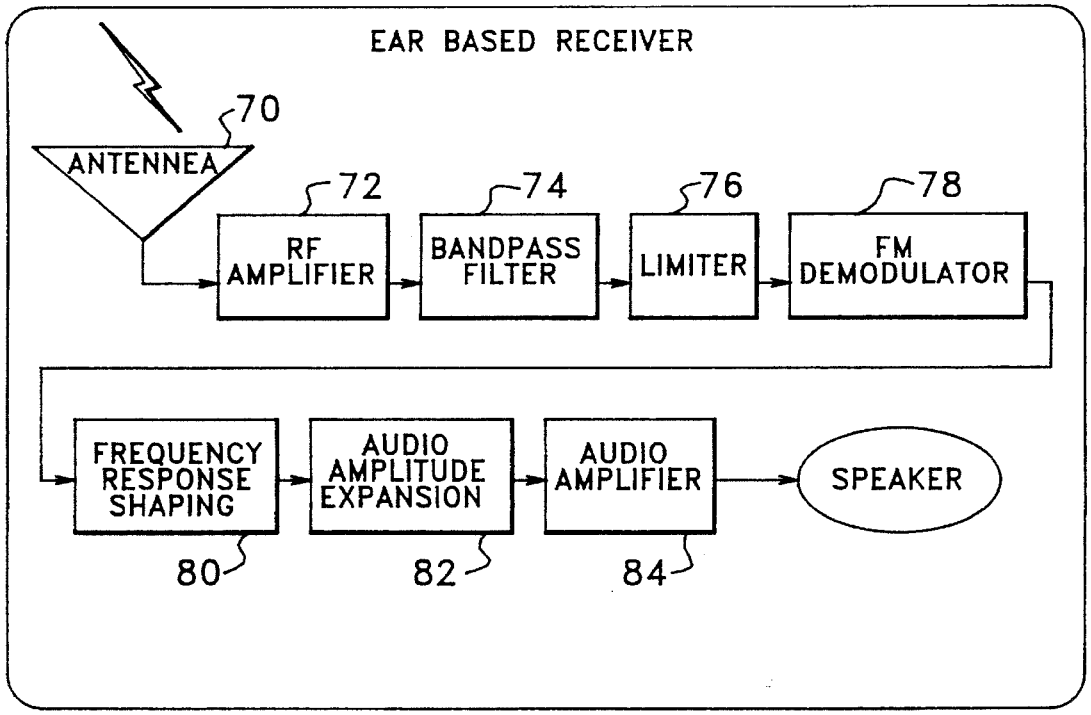
FIG. 2D illustrates an FM receiver at the ear piece for use with the FM transmitter in FIG. 2C to complete the FM output link from the DSP to the ear piece.

In FIG. 2D, the FM receiver in each ear piece for the output links must be small. The antenna 70 is a small ferrite rod. The FM receiver is conventional in design and uses an amplifier 72, bandpass filter 74, amplitude limiter 76, and FM demodulator 78. By choosing the low frequencies for transmission discussed for FIG. 2C, the frequency selective blocks of the receiver can be built without inductors, using only resistors and capacitors. This allows the FM receiver to be packaged very compactly and permits a small size for the ear piece.

After the FM receiver de-modulates the signal, the signal is processed through a frequency shaping circuit 80 and audio amplitude expansion circuit 82. This shaping and expansion is important to maintain signal to noise ratio. An important part of this invention is that the phase and gain effects of this processing can be predicted, and pre-compensated for by the DSP software, so that a flat frequency and phase response is achieved at the system level. Processing stage 58 (FIG. 1B) provided pre-emphasis, and compression of the digital signal as well as compensating for phase and gain effects introduced by the frequency shaping, or deemphasis, circuit 80 and the expansion circuit 82. Finally, amplifier 84 amplifies the left or right audio signal (depending on whether the ear piece is for the left or right ear) and drives the speaker in the ear piece.

For the FM input link, in FIG. 2A the acoustic signal is picked up by a microphone 86. The output of the microphone is pre-emphasized by circuit 88 which amplifies the high frequencies more than the low frequencies. This signal is then compressed by audio amplitude compression circuit 90 to decrease the variation of amplitudes. These pre-emphasis and compression operations improve the signal to noise ratio and dynamic range of the system, and reduce the performance demands placed on the RF link. The effects of this analog processing (pre-emphasis and compression) are reversed in the digital signal processor during the expansion and filter stage 54 (FIG. 1B) of processing. After the compression circuit 90, the signal is frequency modulated by a voltage controlled crystal oscillator 92, and the RF signal is transmitted via antenna 94 to the body pack.

In FIG. 2B, the receiver in the body pack is of conventional design, similar to that used in a consumer FM radio. In each receiver in the body pack, the received signal amplified by RF amplifier 96 is mixed at mixer 98 with the signal from local oscillator 100. Intermediate frequency amplifier 102, filter 104 and amplitude limiter 106 select the signal and limit the amplitude of the signal to be demodulated by the FM demodulator 108. The analog audio output of the demodulator is converted to digital audio by A/D converter 36 (FIG. 1A) and delivered to the DSP.

In the second preferred embodiment, FIGS. 3A–3D, the transmission and reception is implemented with digital transmission links. In this embodiment, the A/D converter 36 and D/A converter 38 are not in the system. The conversions between analog and digital are performed at the ear pieces as a part of sigma delta modulation. In addition, by having a small amount of memory in the transmitters and receivers, all four radio links can share the same frequency band, and do not have to simultaneously receive and transmit signals. The digital modulation can be simple AM. This technique is call time division multiplexing, and is well known to one versed in the art of radio communications.

Figure 3A:
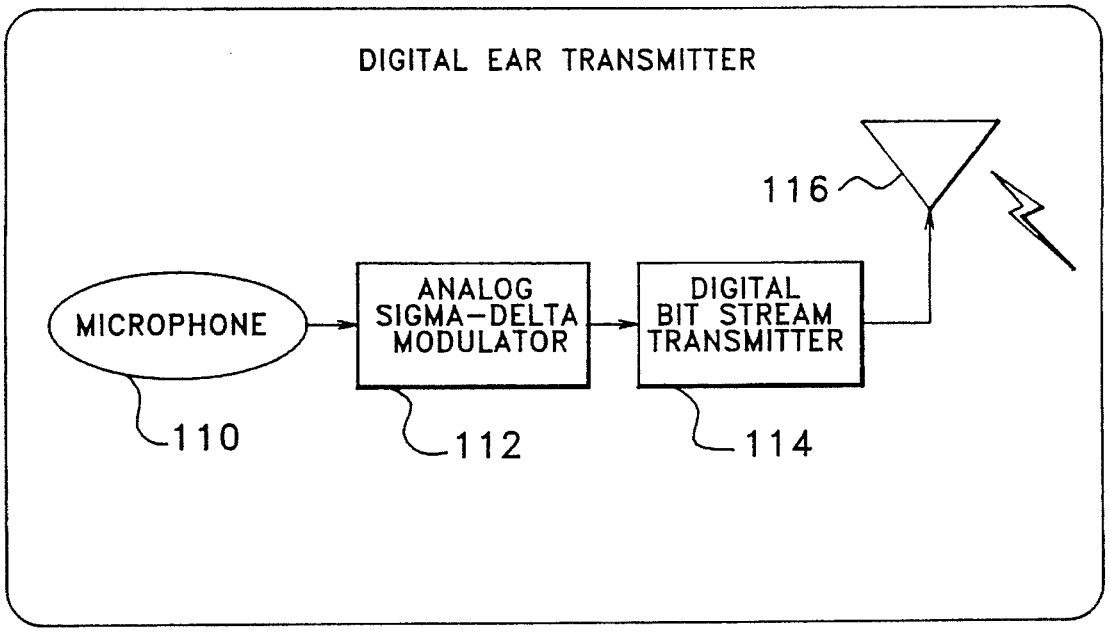
FIG. 3A illustrates an ear piece transmitter for another preferred embodiment of the invention using a sigma-delta modulator in a digital down link for digital transmission of the audio data from ear piece to remote DSP.
Figure 3B:
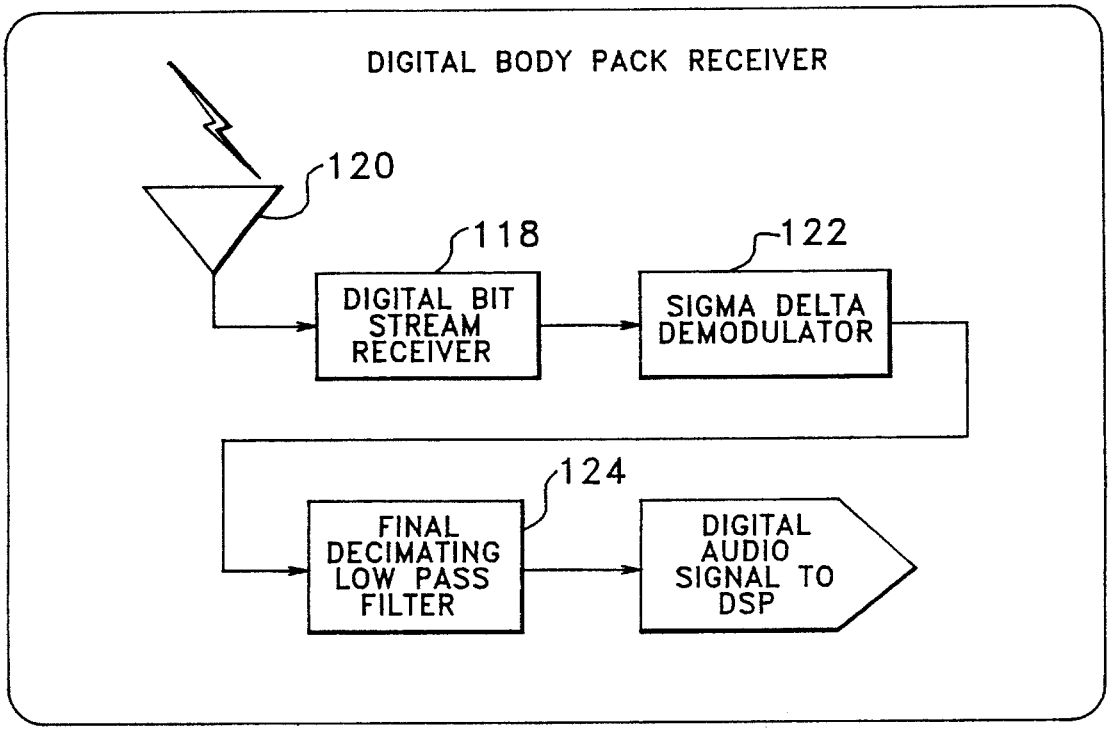
FIG. 3B illustrates a digital receiver at the remote DSP for use in the digital down link from the ear piece transmitter in FIG. 3A.

FIGS. 3A and 3B illustrate the digital down link from an ear piece to the body pack. In FIG. 3A, the analog audio signal from microphone 110 is converted to a modulated digital signal by a sigma-delta modulator 112. The digital bit stream from modulator 112 is transmitted by transmitter 114 via antenna 116.

In FIG. 3B, the receiver 118 regenerates the digital bit stream from the signal received through antenna 120. Sigma delta demodulator 122 along with low pass filter 124 generate the digital audio data to be processed by the DSP.

Figure 3C:
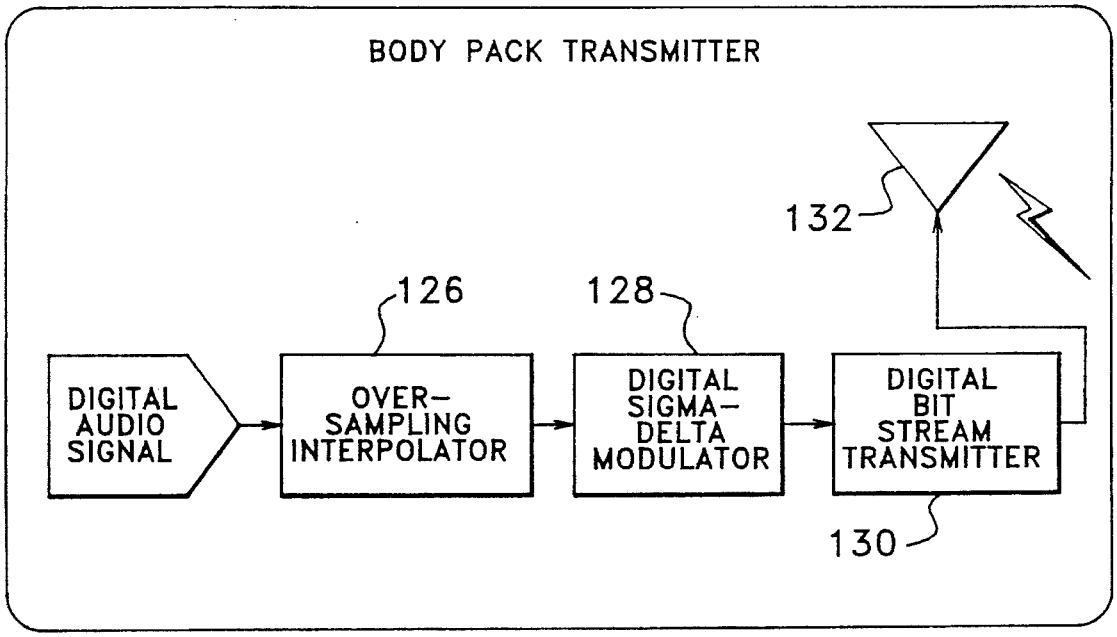
FIG. 3C illustrates a remote DSP transmitter using a sigma-delta modulator in a digital up link for digital transmission of the audio data from remote DSP to ear piece.
Figure 3D:
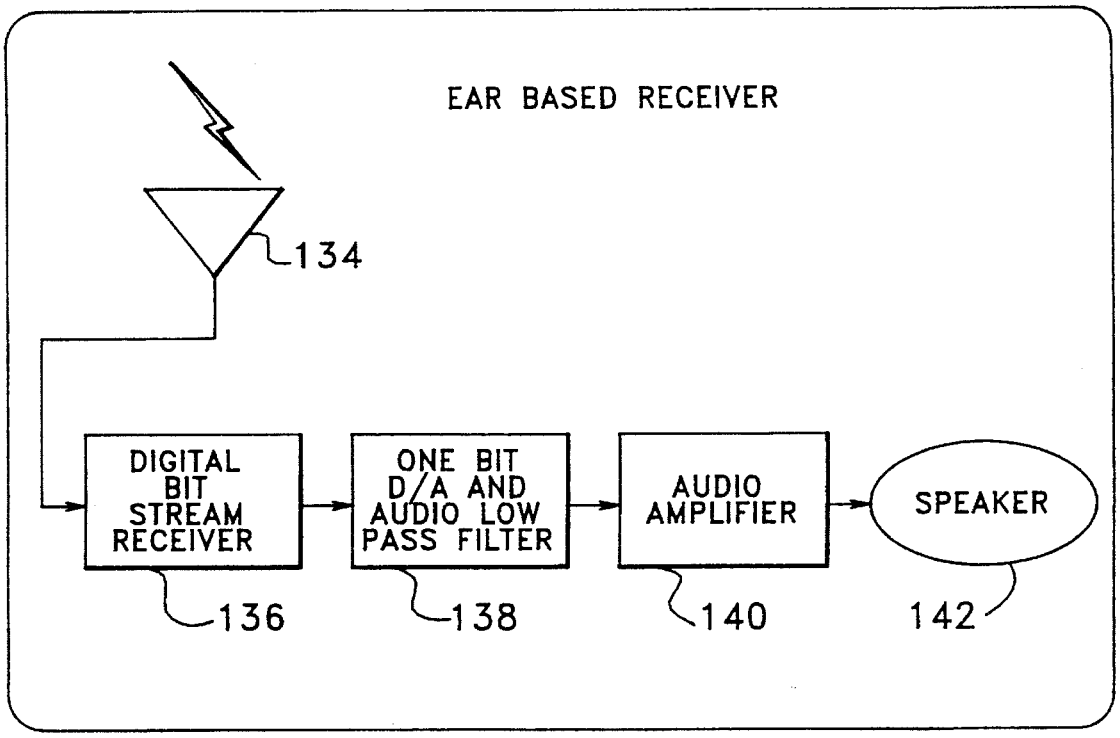
FIG. 3D illustrates a digital receiver at the ear piece for use in the digital up link from the remote DSP transmitter in FIG. 3C.

FIGS. 3C and 3D illustrate one of the digital up links from the body pack to an ear piece. In FIG. 3C, the digital audio signal from the DSP is converted to a modulated digital signal by oversampling interpolator 126 and digital sigma delta modulator 128. The modulated digital signal is transmitter by transmitter 130 via antenna 132.

In FIG. 3D, the received signal picked-up by antenna 134 is demodulated by receiver 136 and passed to D/A converter and low pass filter 138. The analog audio signal from the low pass filter is amplified by amplifier 140 to drive speaker 142.

Figure 4:
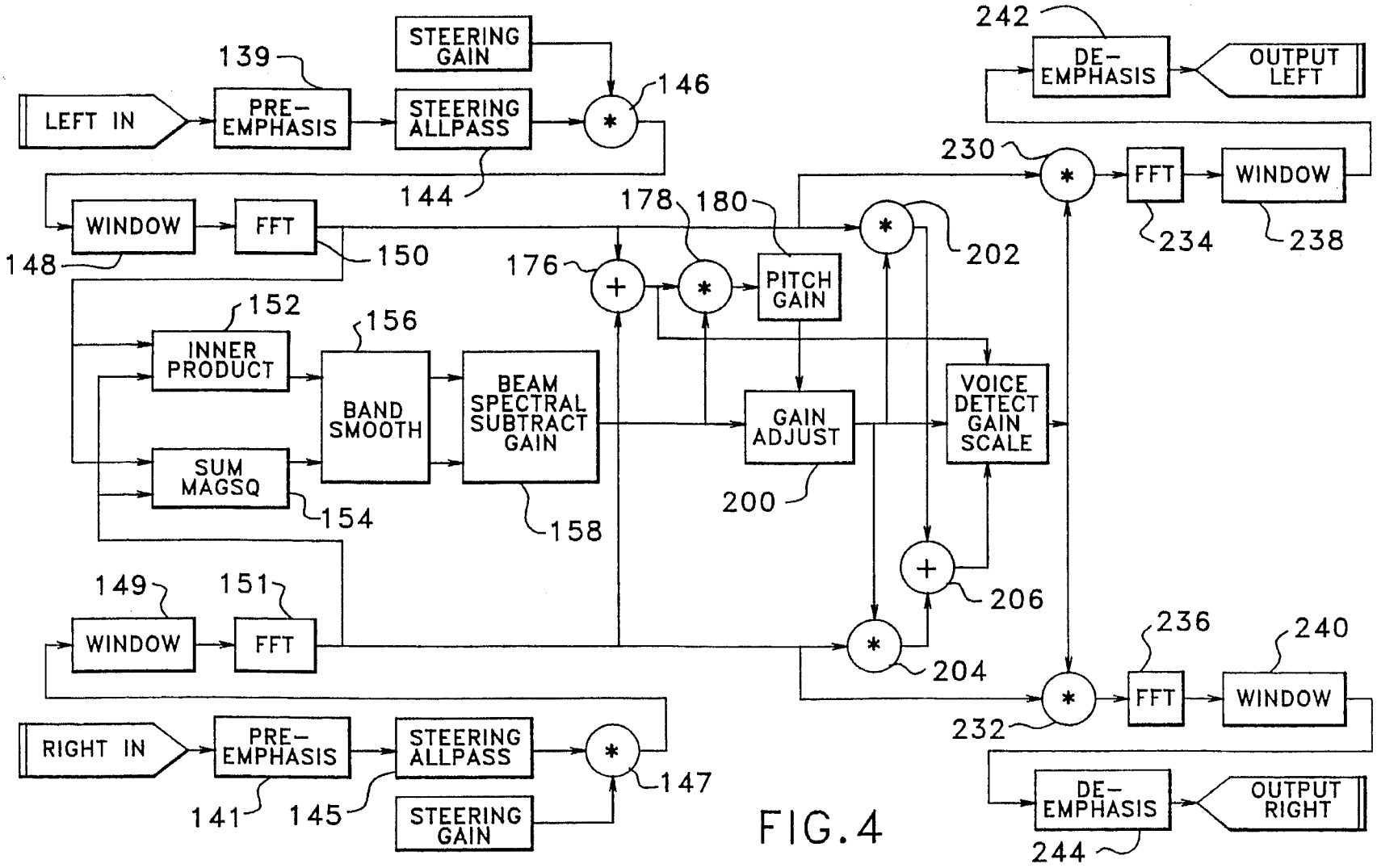
FIG. 4 illustrates the noise reduction processing stage referred to in FIG. 1B.

In FIG. 4, the noise reduction stage, which is implemented as a DSP software program, is shown as an operations flow diagram. The left and right ear microphone signals have been digitized at the system sample rate which is generally adjustable in a range from Fsamp=8–48 kHz but has a nominal value of FSamp 11.025 kHz sampling rate. The time domain digital input signal from each ear is passed to one-zero pre-emphasis filters 139, 141. Pre-emphasis of the left and right ear signals using a simple one-zero high-pass differentiator pre-whitens the signals before they are transformed to the frequency domain. This results in reduced variance between frequency coefficients so that there are fewer problems with numerical errors in the fourier transformation process. The effects of the preemphasis filters 139, 141 are removed after inverse fourier transformation by using one-pole integrator deemphasis filters 242 and 244 on the left and right signals at the end of noise reduction processing. Of course, if binaural compression follows the noise reduction stage of processing the inverse transformation and deemphasis would be at the end of binaural compression.

This preemphasis/deemphasis process is in addition to the preemphasis/deemphasis used before and after radio frequency transmission. However, the effect of these separate preemphasis/deemphasis filters can be combined. In other words, the RF received signal can be left preemphasized so that the DSP does not need to perform an additional preemphasis operation. Likewise, the output of the DSP can be left preemphasized so that no special preemphasis is needed before radio transmission back to the ear pieces. The final deemphasis is done in analog at the ear pieces.

In FIG. 4, after preemphasis, if used, the left and right time domain audio signals are passed through allpass filters 144, 145 to gain multipliers 146, 147. The allpass filter serves as a variable delay. The combination of variable delay and gain allows the direction of the beam in beam forming to be steered to any angle if desired. Thus, the on-axis direction of beam forming may be steered from something other than straight in front of the user or may be tuned to compensate for microphone or other mechanical mismatches.

The noise reduction operation in FIG. 4 is performed on N point blocks. The choice of N is a trade off between frequency resolution and delay in the system. It is also a function of the selected sample rate. For the nominal 11.025 sample rate a value of N=256 has been used. Therefore, the signal is processed in 256 point consecutive sample blocks. After each block is processed, the block origin is advanced by 128 points. So, if the first block spans samples 0 . . . 255 of both the left and right channels, then the second block spans samples 128 . . . 383, the third spans samples 256 . . . 511, etc. The processing of each consecutive block is identical.

The noise reduction processing begins by multiplying the left and right 256 point sample blocks by a sine window in operations 148, 149. A fast Fourier Transform (FFT) operation 150, 151 is then performed on the left and right blocks. Since the signals are real, this yields a 128 point complex frequency vector for both the left and right audio channels. The elements of the complex frequency vectors will be referred to as bin values. So there are 128 frequency bins from F=0 (DC) to F=FSamp/2 kHz.

Figure 5:
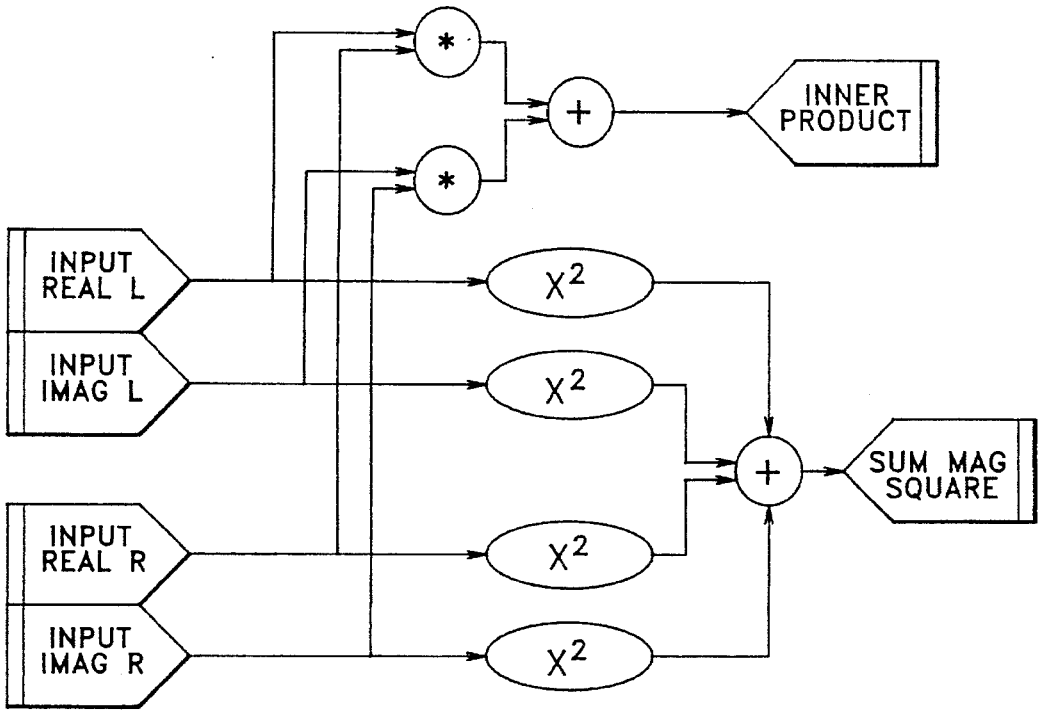
FIG. 5 shows the details of the inner product operation and the sum of magnitudes squared operation referred to in FIG. 4.

The inner product of and the sum of magnitude squares of each frequency bin for the left and right channel complex frequency vector is calculated by operations 152 and 154 respectively. The expression for the inner product is:

$$\textit{Inner Product}(k)=\textit{Real}(\textit{Left}(k))*\textit{Real}(\textit{Right}(k))+\textit{Imag}(\textit{Left}(k))*\textit{Imag}(\textit{Right}(k)$$

and is implemented as shown in FIG. 5. The operation flow in FIG. 5 is repeated for each frequency bin. On the same FIG. 5 the sum of magnitude squares is calculated as:

$$\text{Magnitude Squared Sum}(k) = \text{Real}(\text{Left}(k))\text{^ } 2 + \text{Real}(\text{Right}(k))\text{^ } 2 + \text{Imag}(\text{Left}(k))\text{^ } 2 + \text{Imag}(\text{Right}(k)\text{^ } 2.$$

An inner product and magnitude squared sum are calculated for each frequency bin forming two frequency domain vectors. The inner product and magnitude squared sum vectors are input to the band smooth processing operation 156. The details of the band smoothing operation 156 are shown in FIG. 6.

Figure 6:
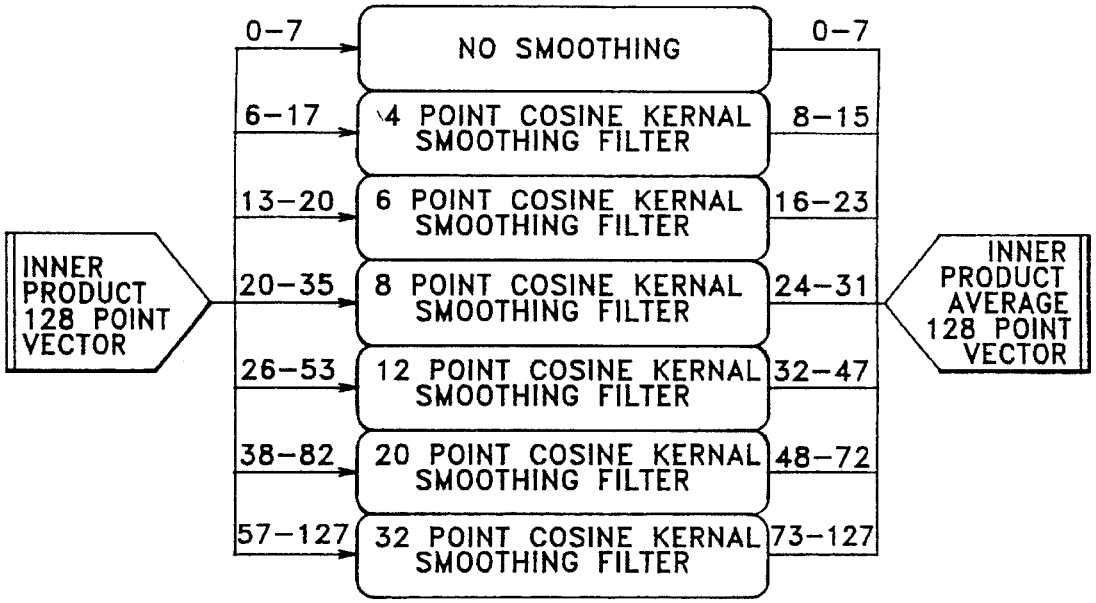
FIG. 6 shows the details of band smoothing operation 156 in FIG. 4.
Figure 6:
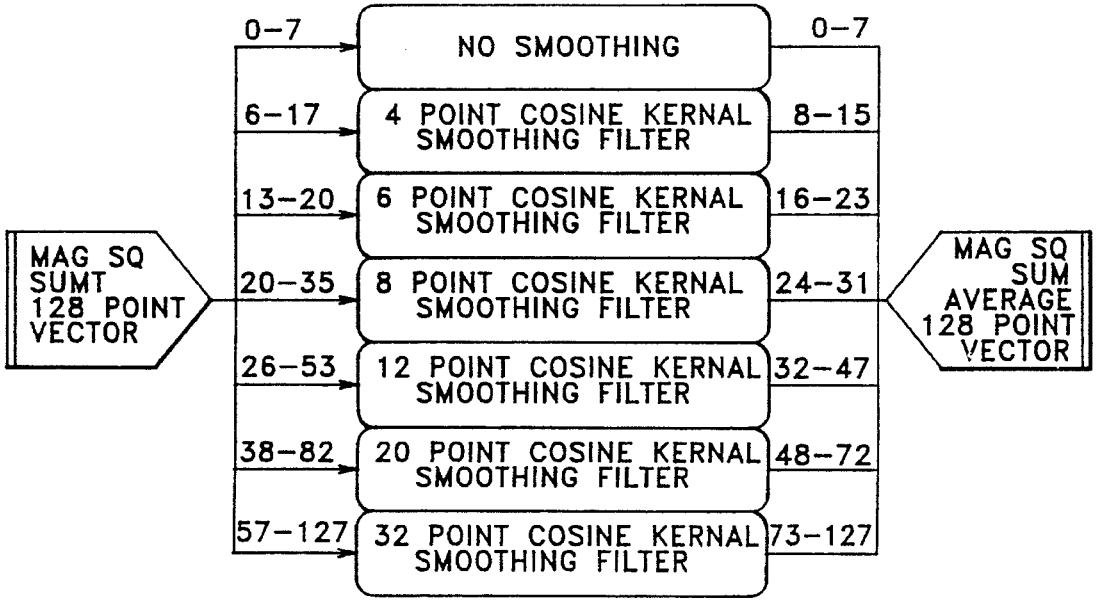

In FIG. 6, the inner product vector and the magnitude square sum vector are 128 point frequency domain vectors. The small numbers on the input lines to the smoothing filters 157 indicate the range of indices in the vector needed for that smoothing filter. For example, the top most filter (no smoothing) for either average has input indices 0 to 7. The small numbers on the output lines of each smoothing filter indicate the range of vector indices output by that filter. For example, the bottom most filter for either average has output indices 73 to 127.

As a result of band smoothing operation 156, the vectors are averaged over frequency according to:

Inner Product Averaged($k$) =

Sum([inner product ($k - L(k)$) . . .

Inner Product($k - L(k)$)] * [Cosine Window])

Mag Sq Sum Averaged($k$) =

Sum([Mag Sq Sum ($k - L(k)$) . . .

Mag Sq Sum($k - L(k)$)] * [Cosine Window])

These functions form Cosine window weighted averages of the inner product and magnitude square sum across frequency bins. The length of the Cosine window increases with frequency so that high frequency averages involve more adjacent frequency points then low frequency averages. The purpose of this averaging is to reduce the effects of spatial aliasing.

Spatial aliasing occurs when the wave lengths of signals arriving at the left and right ears are shorter than the space between the ears. When this occurs a signal arriving from off-axis can appear to be perfectly in-phase with respect to the two ears even though there may have been a K*2*PI (K some integer) phase shift between the ears. Axis in "off-axis" refers to the centerline perpendicular to a line between the ears of the user; i.e. the forward direction from the eyes of the user. This spatial aliasing phenomenon occurs for frequencies above approximately 1500 Hz. If the real world signals consist of many spectral lines and at high frequencies these spectral lines achieve a certain density over frequency—this is especially true for consonant speech sounds—and if the estimate of directionality for these frequency points are averaged, an on-axis signal continues to appear on-axis. However, an off-axis signal will now consistently appear off-axis since for a large number of spectral lines, densely spaced, it is impossible for all or even a significant percentage of them to have exactly integer K*2*PI phase shifts.

The inner product average and magnitude squared sum average vectors are then passed from the band smoother 156 to the beam spectral subtract gain operation 158. This gain operation uses the two vectors to calculate a gain per frequency bin. This gain will be low for frequency bins, where the sound is off-axis and/or below a spectral subtraction threshold, and high for frequency bins where the sound is on-axis and above the spectral subtraction threshold. The beam spectral subtract gain operation is repeated for every frequency bin.

Figure 7:
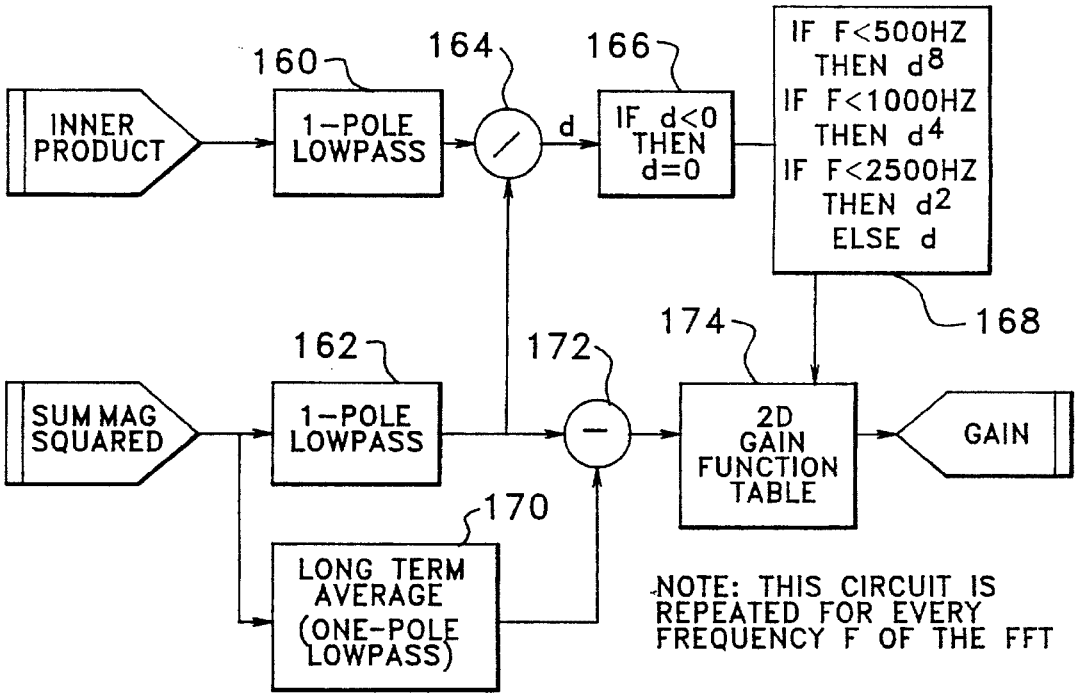
FIG. 7 shows the details of the beam spectral subtract gain operation 158 in FIG. 4.

The beam spectral subtract gain operation 158 in FIG. 4 is shown in detail in FIG. 7. The inner product average and magnitude square sum average for each bin are smoothed temporally using one pole filters 160 and 162 in FIG. 7. The ratio of the temporally smoothed inner product average and magnitude square sum average is then generated by operation 164. This ratio is the preliminary direction estimate "d" equivalent to:

$d$ = Average ((Mag Left($k$) * Mag Right($k$) * cos(Angle Left($k$) − Angle Right($k$))))/

Average((Mag Sq Left + Mag Sq Right))

The ratio, or d estimate, is a smoothing function which equals 0.5 when the Angle Left=Angle Right and when Mag Left=Mag Right. That is when the values for frequency bin k are the same in both the left and right channels. As the magnitude or phase angles differ, the function tends toward zero and goes negative for PI/2<Angle Diff<3PI/2. For d negative, d is forced to zero in operation 166. It is significant that the d estimate uses both phase angle and magnitude differences, thus incorporating maximum information in the d estimate. The direction estimate d is then passed through a frequency dependent nonlinearity operation 168 which raises d to higher powers at lower frequencies. The effect is to cause the direction estimate to tend towards zero more rapidly at low frequencies. This is desirable since the wave lengths are longer at low frequencies and so the angle differences observed are smaller.

If the inner product and magnitude squared sum temporal averages were not formed before forming the ratio d then the result would be excessive modulation from segment to segment resulting in a choppy output. Alternatively, the averages could be eliminated and instead the resulting estimate d could be averaged, but this is not the preferred embodiment.

The magnitude square sum average is passed through a long term averaging filter 170 which is a one pole filter with a very long time constant. The output from one pole smoothing filter 162, which smooths the magnitude square sum is subtracted at operation 172 from the long term average provided by filter 170. This yields an excursion estimate value representing the excursions of the short term magnitude sum above and below the long term average and provides a basis for spectral subtraction. Both the direction estimate and the excursion estimate are input to a two dimensional lookup table 174 which yields the beam spectral subtract gain.

Figure 8:
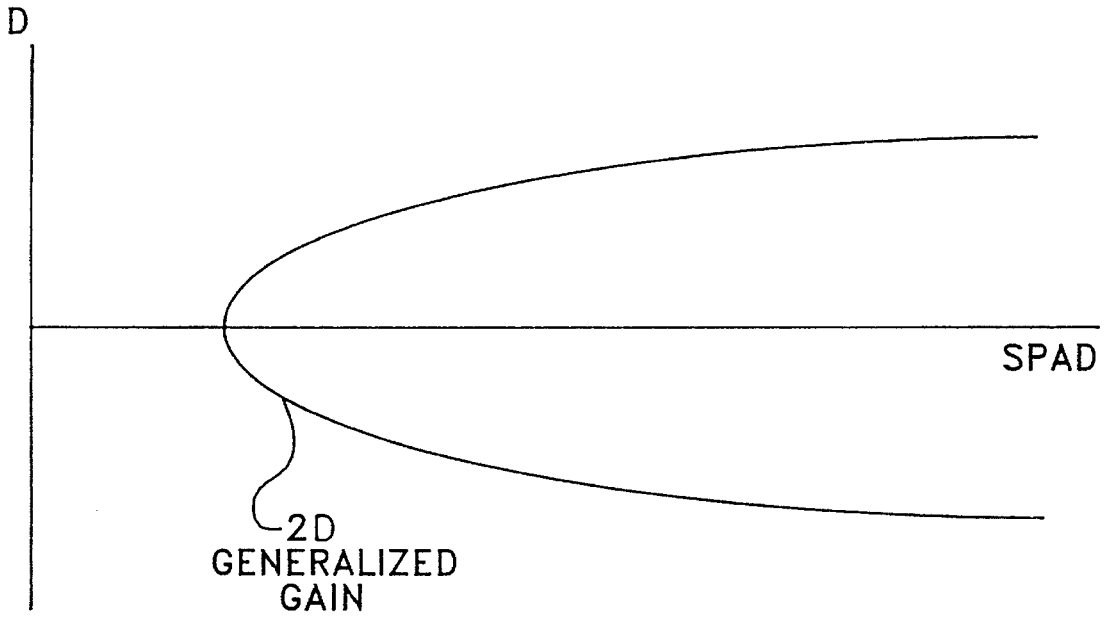
FIG. 8 is a graph of the noise reduction gain as a function of directionality estimate and spectral subtraction estimate in accordance with the process in FIG. 7.

The two-dimensional lookup table 174 provides an output gain that takes the form shown in FIG. 8. The region inside the arched shape represents values of direction estimate and excursion estimate for which gain is near one. At the boundaries of this region the gain falls off gradually to zero. Since the two dimensional table is a general function of directionality estimate and spectral subtraction excursion estimate, and since it is implemented in read/write random access memory, it can be modified dynamically for the purpose of changing beamwidths.

The beamformed/spectral subtracted spectrum is usually distorted compared to the original desired signal. When the spatial window is quite narrow then these distortions are due to elimination of parts of the spectrum which correspond to desired on-line signal. In other words, the beamformer/spectral subtractor has been too pessimistic. The next operations in FIG. 4 involving pitch estimation and calculation of a Pitch Gain help to alleviate this problem.

Figure 9:
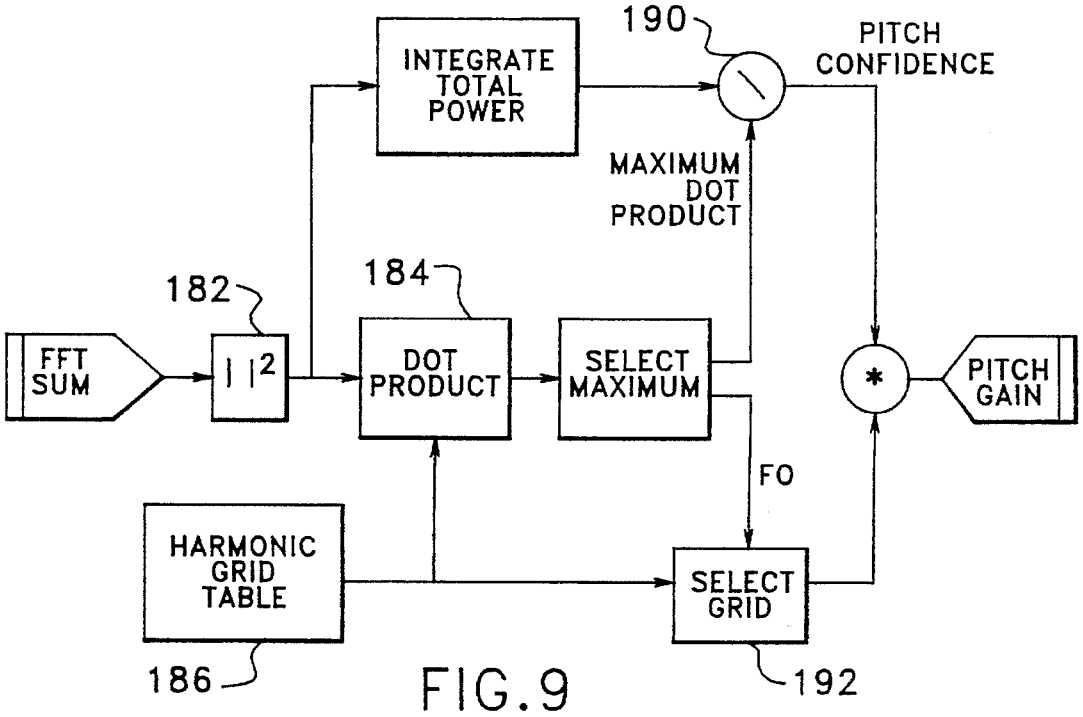
FIG. 9 shows the details of the pitch-estimate gain operation 180 in FIG. 4.

In FIG. 4, the complex sum of the left and right channel from FFTs 150 and 152, respectively, is generated at operation 176. The complex sum is multiplied at operation 178 by the beam spectral subtraction gain to provide a partially noise-reduced monaural complex spectrum. This spectrum is then passed to the pitch gain operation 180 which is shown in detail in FIG. 9.

The pitch estimate begins by first calculating at operation 182 the power spectrum of the partially noise-reduced spectrum from multiplier 178 (FIG. 4). Next, operation 184 computes the dot product of this power spectrum with a number of candidate harmonic spectral grids from table 186. Each candidate harmonic grid consists of harmonically related spectral lines of unit amplitude. The spacing between the spectral lines in the harmonic grid determines the fundamental frequency to be tested. Fundamental frequencies between 60 and 400 hZ with candidate pitches taken at 1/24 of an octave intervals are tested. The fundamental frequency of the harmonic grid which yields the maximum dot product of operation 187 is taken as $F_0$, the fundamental frequency, of the desired signal. The ratio generated by operation 190 of the maximum dot product to the overall power in the spectrum gives a measure of confidence in the pitch estimate. The harmonic grid related to $F_0$ is selected from table 186 by operation 192 and used to form the pitch gain. Multiply operation 194 produces the $F_0$ harmonic grid scaled by the pitch confidence measure. This is the pitch gain vector.

In FIG. 4, both pitch gain and beam spectral subtract gain are input to gain adjust operation 200. The output of the gain adjust operation is the final per frequency bin noise reduction gain. For each frequency bin, the maximum of pitch gain and beam spectral subtract gain is selected in operation 200 as the noise reduction gain.

Since the pitch estimate is formed from the partially noise reduced signal, it has a strong probability of reflecting the pitch of the desired signal. A pitch estimate based on the original noisy signal would be extremely unreliable due to the complex mix of desired signal and undesired signals.

The original frequency domain, left and right ear signals from FFTs 150 and 151 are multiplied by the noise reduction gain at multiply operations 202 and 204. A sum of the noise reduced signals is provided by summing operation 206. The sum of noise reduced signals from summer 206, the sum of the original non-noise reduced left and right ear frequency domain signals from summer 176, and the noise reduction gain are input to the voice detect gain scale operation 208 shown in detail in FIG. 10.

Figure 10:
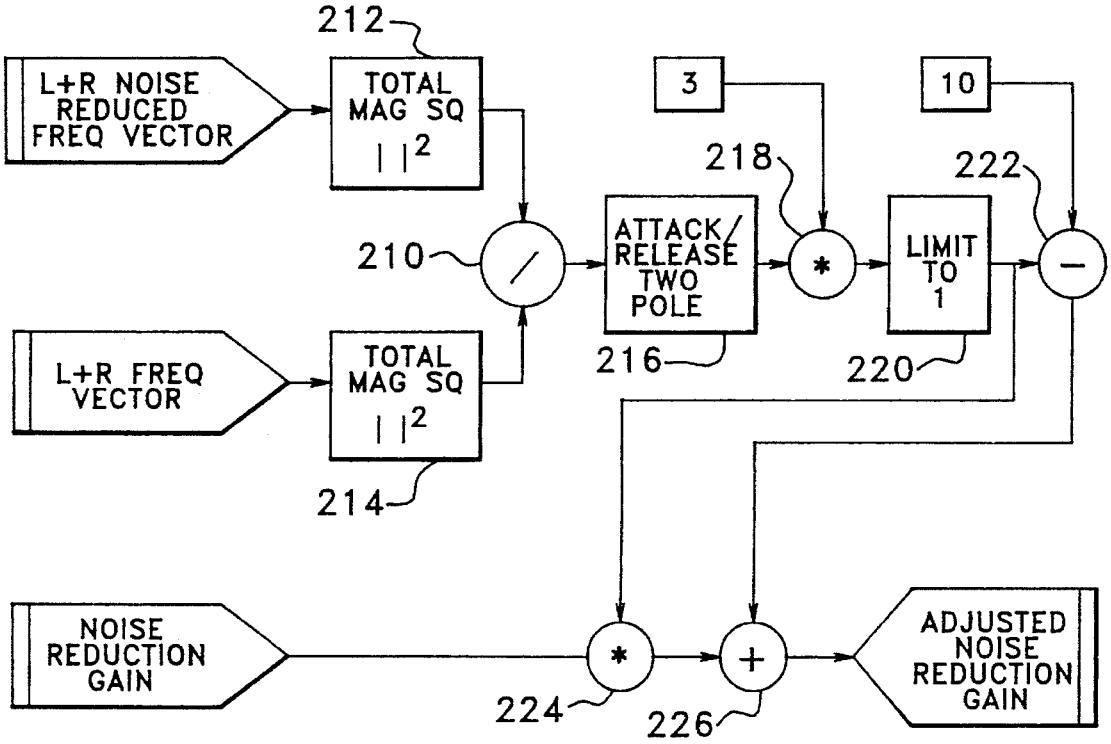
FIG. 10 shows the details of the voice detect gain scaling operation 208 in FIG. 4.

In FIG. 10, the voice detect gain scale operation begins by calculating at operation 210 the ratio of the total power in the summed left and right noise reduced signals to the total power of the summed left and right original signals. Total magnitude square operations 212 and 214 generate the total power values. The ratio is greater the more noise reduced signal energy there is compared to original signal energy. This ratio (VoiceDetect) serves as an indicator of the presence of desired signal. The VoiceDetect is fed to a two-pole filter 216 with two time constants: a fast time constant (approximately 10 ms) when VoiceDetect is increasing and a slow time constant (approximately 2 seconds) when voice detect is decreasing. The output of this filter will move immediately towards unity when VoiceDetect goes towards unity and will decay gradually towards zero when VoiceDetect goes towards zero and stays there. The object is then to reduce the effect of the noise reduction gain when the filtered VoiceDetect is near zero and to increase its effect when the filtered VoiceDetect is near unity.

The filtered VoiceDetect is scaled upward by three at multiply operation 218 and limited to a maximum of one at operation 220 so that when there is desired on-axis signal the value approaches and is limited to one. The output from operation 220 therefore varies between 0 and 1 and is a VoiceDetect confidence measure. The remaining arithmetic operations 222,224 and 226 scale the noise reduction gain based on the VoiceDetect confidence measure in accordance with the expression:

Final Gain = $(G_{NR} * \text{Conf}) + (1 - \text{Conf})$, where:
$G_{NR}$ is noise reduction gain,
Conf is the VoiceDetect confidence measure.

In FIG. 4, the final VoiceDetect Scaled Noise Reduction Gain is used by multipliers 230 and 232 to scale the original left and right ear frequency domain signals. The left and right ear noise reduced frequency domain signals are then inverse transformed at FFTs 234 and 236. The resulting time domain segments are windowed with a sine window and 2:1 overlap-added to generate a left and right signal from window operations 238 and 240. The left and right signals are then passed through deemphasis filters 242, 244 to produce the stereo output signal. This completes the noise reduction processing stage.

As discussed earlier for FIG. 1B, a binaural compressor stage is implemented by the DSP after the noise reduction stage. The purpose of binaural compression is to reduce the dynamic range of the enhanced audio signal while preserving the directionality information in the binaural audio signals. The preferred embodiment of the binaural compression stage is shown in FIG. 11.

Figure 11:
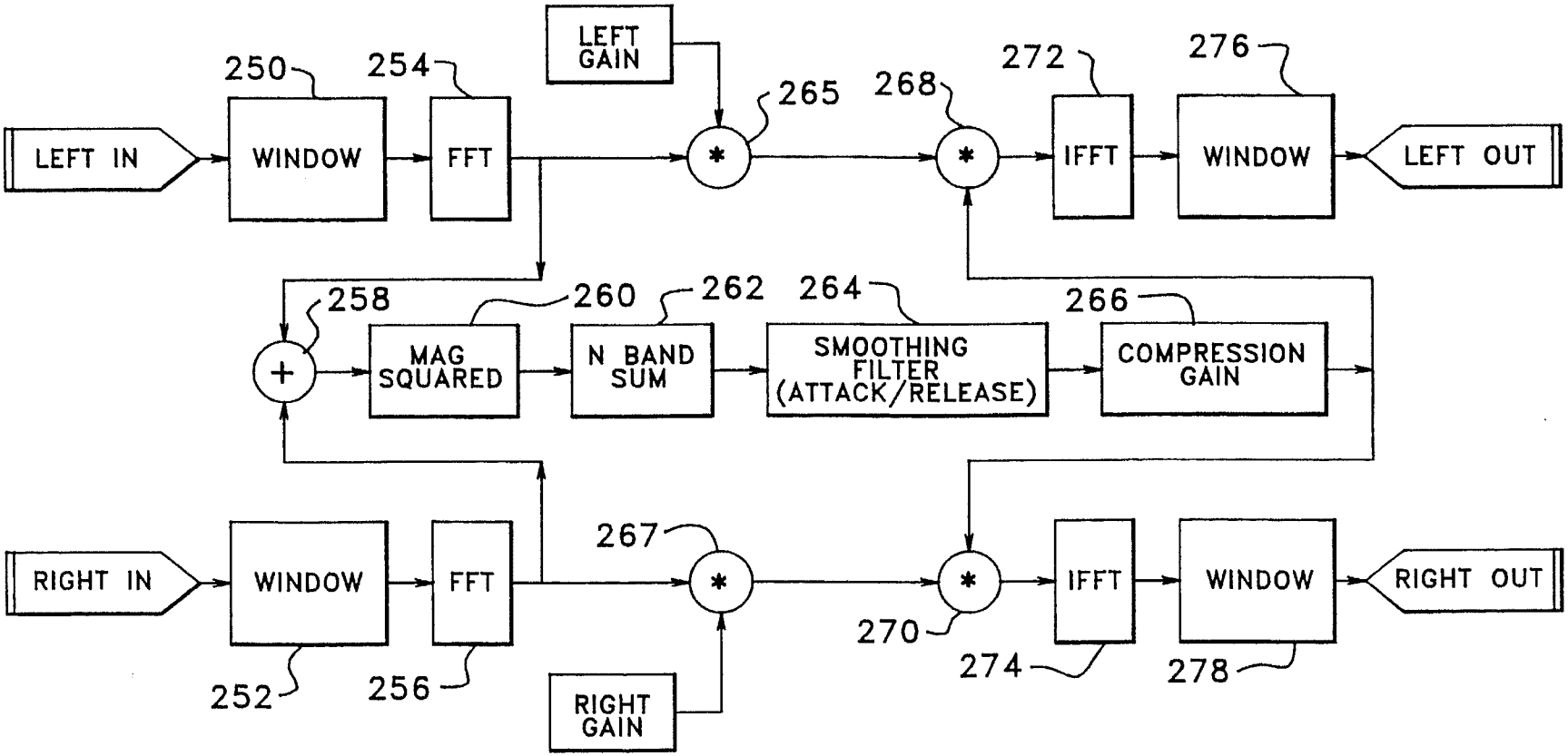
FIG. 11 illustrates the operations performed by the DSP in the binaural compression stage 57 of FIG. 1B.

In FIG. 11 the two digital signals arriving for the left and right ear are sine windowed by operations 250, 252 and fourier transformed by FFT operations 254 and 256. If the binaural compression follows the noise reduction stage as described above, the windowing and FFTs will already have been performed by the noise reduction stage. The left and right channels are summed at operation 258 by summing corresponding frequency bins of the left and right channel FFTs. The magnitude square of the FFT sum is computed at operation 260.

The bins of the magnitude square are grouped into N bands where each band consists of some number of contiguous bins. N can range from 1 to approximately 19 and represents the number of bands of the compressor which can range from a single band (N=1) to 19 bands (N=19). N=19 would approximate the number of critical bands in the human auditory system. (Critical bands are the critical resolution frequency bands used by the ear to distinguish seperate sounds by frequency.) The bands will generally be arranged so that the number of bins in progressively higher frequency bands increases logarithmically just as do bandwidths of critical bands. The bins in each of the N bands are summed at operation 262 to provide N band power estimates.

The N power estimates are smoothed in time by passing each through a two pole smoothing filter 264. The two pole filter is composed of a cascade of two real one-pole filters. The filters have asymmetrical rising and falling time constants. If the magnitude square is increasing in time then one set of filter coefficients is used. If the magnitude square is decreasing then another set of filter coefficients is used. This allows attack and release time constants to be set. The filter coefficients can be different in each of the N bands.

Each of the N smoothed power estimates is passed through a nonlinear gain function 266 whose output gives the gain necessary to achieve the desired compression ratio. The compression ratio may be set independently for each band. The nonlinear function is implemented as a third order polynomial approximation to the function:

$Gc = 1/(Pi)^{\wedge}\ (.5 - .5r)$ where:
$Pi$ = smoothed power estimate,
$r$ = compression ratio,
$Gc$ = compression gain.

The original left and right FFT vectors are multiplied in operations 265, 267 by left gain and right gain vectors. The left gain and right gain vectors are frequency response adjustment vectors which are specific to each user and are a function of the audiogram measurements of hearing loss of the user. These measurements would be taken during the fitting process for the hearing aid.

After operations 265, 267 the equalized left and right FFT vectors are scalar multiplied by the compression gain in multiply operations 268 and 270. Since the same compression gain is applied to both channels, the amplitude differences between signals received at the ears are preserved. Since the general system architecture guarantees that phase relationships in signals from the ears are preserved then differences in time of arrival of the sound at each ear is preserved. Since amplitude differences and time of arrival relationships for the ears are preserved, the directionality cues are preserved.

After the compression gain is applied in bands to each of the left and right signals, the inverse FFT operations 272, 274 and sine window operations 276, 278 yield time domain left and right digital audio signals. These signals are then passed to the RF link pre-emphasis and compression stage 58 (FIG. 1B).

While a number of preferred embodiments of the invention have been shown and described, it will be appreciated by one skilled in the art, that a number of further variations or modifications may be made without departing from the spirit and scope of our invention.

What is claimed is:

1. In a binaural hearing enhancement system having a right ear piece with microphone and speaker, a left ear piece with microphone and speaker and a body pack for remote electronics in the system, apparatus for enhancing left and right audio signals comprising:

transceiver means in each ear piece for transmitting right and left input audio signals to the body pack and for receiving right and left output audio signals from the body pack;

stereo transceiver means in the body pack for receiving the right and left input audio signals from the right and left ear pieces and for transmitting right and left output audio signals from the body pack;

left filter means in the body pack for filtering the left input audio signals to compensate for amplitude and phase distortion introduced in audio signals by a left ear microphone or a pre-emphasis filter in the left ear piece;

right filter means in the body pack for filtering the right input audio signals to compensate for amplitude and phase distortion introduced in audio signals by a right ear microphone or a pre-emphasis filter in the right ear piece; and each of left and right filter means generating a flat, linear-phase, frequency response for the left and right input audio signals in order to deliver undistorted amplitude and phase-aligned left and right signals as left and right distortion-free signals to enhancing means whereby the left and right distortion-free signals accurately reflect interaural amplitude differences and delay differences at the ears;

means for enhancing each of the left and right distortion-free signals based on audio information derived from both the left and right distortion-free signals to produce enhanced left and right output audio signals for transmission to the ear pieces.

2. The system of claim 1 wherein said enhancing means comprises:

means responsive to the left and right distortion-free signals for reducing the noise in each of the left and right signals based on the amplitude and phase differences between the left and right audio signals to produce directional sensitive noise reduced left and right output audio signals for transmission to the right and left ear pieces.

3. The system of claim 2 wherein a user of the hearing aid has predetermined audio requirements for hearing enhancement and said enhancing means further comprises:

means responsive to noise reduced left and right audio signals for compressing the dynamic range of audio signals and for adjusting the left and right audio signals to match the audio requirements of a user of the hearing enhancement system.

4. The system of claim 2 wherein said enhancing means further comprises:

means responsive to the left and right distortion-free signals for reducing the noise in each of the left and right signals based on the short term amplitude deviation from long term average and the pitch in both the left and right distortion-free signals.

5. The apparatus of claim 1 and in addition:

second left filter means for filtering the noise reduced left output audio signal to cancel the effect of left ear resonances and nulls and left ear speaker amplitude and phase distortions;

second right filter means for filtering the noise reduced right output audio signal to cancel the effect of right ear resonances and nulls and right ear speaker amplitude and phase distortions; and each of said second left and right filter means generating a flat, linear-phase, frequency response for the noise reduced left and right output audio signals at the left and right ears.

6. The apparatus in claim 1 and in addition:

compression means in each ear piece for compressing the dynamic range of the audio signal before the audio signal is transmitted by the transceiver in the ear piece; and expanding means in said compensating means for restoring the dynamic range of the left and right audio signals received from the ear piece.

7. The apparatus of claim 6 and in addition:

second left filter means for filtering the noise reduced left audio signal to cancel the effect of ear resonances and nulls and left ear speaker amplitude and phase distortions;

second right filter means for filtering the noise reduced right audio signal to cancel the effect of ear resonances and nulls and right ear speaker amplitude and phase distortions;

each of said second left and right filter means generating a flat, linear-phase, frequency response for the noise reduced left and right audio signals at the left and right ears.

8. The apparatus of claim 7 and in addition:

compression means in the body pack for compressing in the dynamic range of the noise reduced left and right audio signal before the noise reduced audio signals are transmitted by transceivers in the body pack to each ear piece; and expanding means in each of the ear pieces for restoring the dynamic range of the noise reduced left and right audio signals received from the ear pieces.

9. Binaural, digital, hearing aid apparatus comprising:

right ear piece means for mounting microphone means for detecting sound and producing a right ear, electrical, audio signal, a speaker means for reproducing sound from a right ear, electrical, enhanced audio signal, left ear transmitter means for transmitting the right ear audio signal as radiant energy and left ear receiver means for receiving radiant energy transmission of the right ear enhanced audio signal;

left ear piece means for mounting microphone means for detecting sound and producing a left ear, electrical, audio signal, a speaker means for reproducing sound from a left ear, electrical, enhanced audio signal, left ear transmitter means for transmitting the right ear audio signal as radiant energy and left ear receiver means for receiving radiant energy transmission of the right ear enhanced audio signal;

remote means for receiving the left and right audio signals, enhancing the left and right audio signals, and transmitting the enhanced left and right audio signals;

said remote means having means for converting the received left and right audio signals into left and right digital data;

means for compensating the left and right digital data for phase and amplitude distortions in the received left and right audio signals to produce distortion-free left and right digital data that preserves amplitude and phase differences between the left and right audio signals;

means for digitally processing the distortion-free left and right digital data interactively with each other to produce enhanced digital left and right data; and means for converting the enhanced digital left and right data into the left and right enhanced audio signals for transmission by said remote means.

10. The hearing aid apparatus of claim 9 wherein said digital processing means comprises:

means responsive to the distortion-free left and right digital data for reducing the directional-sensitive noise in the left and right digital data based on the amplitude and phase differences in the left and right audio signals.

11. The hearing aid apparatus of claim 10 wherein said digital processing means further comprises:

means responsive to the distortion-free left and right digital data signals for reducing the noise in each of the left and right digital data signals based on the short term amplitude deviation from long term average and pitch in both the left and right distortion-free digital data signals.

12. In a binaural hearing enhancement system having a right ear piece, a left ear piece and an audio signal processor for processing left and right audio signals in the system, apparatus for enhancing the left and right audio signals comprising:

microphone and electronic means in each ear piece for producing an input audio signal from sound arriving at the ear piece;

speaker and electronic means in each ear piece for producing sound from an output audio signal from the audio signal processor;

left filter means in the audio signal processor for filtering the left input audio signals to compensate for amplitude and phase distortion introduced in audio signals by the microphone and electronic means in the left ear piece;

right filter means in the remote electronics for filtering the right input audio signals to compensate for amplitude and phase distortion introduced in audio signals by the microphone and electronic means in the right ear piece; and each of left and right filter means generating a flat, linear-phase, frequency response for the left and right input audio signals in order to provide undistorted amplitude and phase-aligned left and right signals as left and right distortion-free signals whereby the left and right distortion-free signals accurately reflect interaural amplitude differences and delay differences at the ears;

means for enhancing each of the left and right distortion-free signals based on audio information derived from both the left and right distortion-free signals to produce enhanced left and right output audio signals for the left and right ear pieces, respectively.

13. The system of claim 12 wherein said enhancing means comprises:

means responsive to the left and right distortion-free signals for reducing the noise in each of the left and right signals based on the amplitude and phase differences between the left and right audio signals to produce directional-sensitive noise reduced left and right output audio signals for the right and left ear pieces.

14. The system of claim 13 wherein a user of the hearing aid has predetermined audio requirements for hearing enhancement and said enhancing means further comprises:

means responsive to noise reduced left and right audio signals for compressing the dynamic range of audio signals and for adjusting the left and right audio signals to match the audio requirements of a user of the hearing enhancement system.

15. The system of claim 12 wherein said enhancing means further comprises:

means responsive to the left and right distortion-free signals for reducing the noise in each of the left and right signals based on the short term amplitude deviation from long term average and the pitch in both the left and right distortion-free signals.

* * * * *